US006769233B2

(12) United States Patent
Hadlock

(10) Patent No.: US 6,769,233 B2
(45) Date of Patent: Aug. 3, 2004

(54) SYSTEM AND METHOD FOR FITTING A HORSE WITH A RIDING SADDLE OR SADDLE PAD

(76) Inventor: William Bret Hadlock, 311 Hi-Way 306, New Braunfels, TX (US) 78130

( * ) Notice: Subject to any disclaimer, the term of this patent is extended or adjusted under 35 U.S.C. 154(b) by 0 days.

(21) Appl. No.: 10/235,229

(22) Filed: Sep. 5, 2002

(65) Prior Publication Data

US 2004/0112017 A1 Jun. 17, 2004

(51) Int. Cl.[7] ..... B68C 1/02
(52) U.S. Cl. ..... 54/44.1
(58) Field of Search ..... 54/44.1, 65, 66

(56) References Cited

U.S. PATENT DOCUMENTS

| | | | |
|---|---|---|---|
| D31,409 | S | 8/1899 | Padgitt |
| 1,357,823 | A | 11/1920 | Read |
| 2,072,188 | A | 3/1937 | Tauber |
| 3,130,530 | A | 4/1964 | Foreman |
| 3,286,440 | A | 11/1966 | Walker et al. |
| 3,323,287 | A | 6/1967 | Hilmer |
| 3,371,467 | A | 3/1968 | Sailsbury, III |
| 3,624,695 | A | 11/1971 | Roberts, Jr. |
| 3,807,136 | A | 4/1974 | Deal |
| 3,835,621 | A | 9/1974 | Gorenschek |
| 3,888,070 | A | 6/1975 | White et al. |
| 3,971,194 | A | 7/1976 | Morgan |
| 4,136,506 | A | 1/1979 | Miller |
| D251,623 | S | 4/1979 | Abercrombie, Jr. |
| 4,287,705 | A | 9/1981 | Frost et al. |
| 4,324,090 | A | 4/1982 | Nix |
| 4,471,538 | A | 9/1984 | Pomeranz et al. |
| 4,524,570 | A | 6/1985 | Racinet |
| 4,669,255 | A | 6/1987 | Wicks |
| 4,671,049 | A | 6/1987 | Benckhuijsen |
| 4,683,709 | A | 8/1987 | Vasko et al. |
| 4,695,496 | A | 9/1987 | Lee |
| 4,745,734 | A | 5/1988 | Brown |
| 4,765,126 | A | 8/1988 | Bates |
| 4,860,524 | A | 8/1989 | Dumoulin et al. |
| 4,965,988 | A | 10/1990 | Anderson |
| 4,974,397 | A | 12/1990 | Ricken |
| 5,018,340 | A | 5/1991 | Marshall |
| 5,018,341 | A | 5/1991 | Everston |
| 5,027,589 | A | 7/1991 | Gleb et al. |
| 5,048,272 | A | 9/1991 | Saare |

(List continued on next page.)

FOREIGN PATENT DOCUMENTS

| | | |
|---|---|---|
| EP | 0566608 B1 | 1/1998 |
| EP | 0764607 B1 | 5/2000 |
| GB | 18176 | of 1894 |
| GB | 378365 | 8/1932 |
| WO | WO 9602460 A1 | 2/1996 |
| WO | WO 99/18028 | 4/1999 |

OTHER PUBLICATIONS

EQUImeasure Kit. EQUImeasure Incorporated. Nov. 12, 2001.

*Primary Examiner*—Charles T. Jordan
*Assistant Examiner*—Bret Hayes
(74) *Attorney, Agent, or Firm*—Charles W. Hanor, P.C.

(57) ABSTRACT

A method and system for custom fitting a horse's back with a fitted saddle pad or saddle. A plurality of different sized and shaped rigid molded shells are used for fitting to a horse's back to determine the proper size and shape shell for the horse to distribute the weight of a rider over a large area of the horse's back to minimize pressure points. The fitting shells have spaced holes to allow a fitter to determine the correct size shell for selecting a molded shell for the horse to determine the size and shape of the horse's back for a properly fitted saddle pad or saddle so that substantially the entire lower surface of the saddle pad or saddle contacts the horse's back to minimize pressure points.

1 Claim, 2 Drawing Sheets

U.S. PATENT DOCUMENTS

| | | | | |
|---|---|---|---|---|
| 5,058,367 | A | | 10/1991 | Everston |
| 5,175,986 | A | | 1/1993 | Farley |
| 5,191,752 | A | | 3/1993 | Murphy |
| 5,195,306 | A | | 3/1993 | Hadlock |
| 5,343,674 | A | | 9/1994 | Brown |
| 5,375,397 | A | | 12/1994 | Ferrand et al. |
| 5,383,328 | A | | 1/1995 | Brown |
| 5,435,116 | A | | 7/1995 | Brown |
| 5,456,072 | A | | 10/1995 | Stern |
| 5,517,808 | A | | 5/1996 | Schleese |
| 5,575,139 | A | | 11/1996 | Green |
| 5,577,372 | A | | 11/1996 | Gronberg |
| 5,782,070 | A | | 7/1998 | Knight et al. |
| 5,787,692 | A | | 8/1998 | Purdy |
| 5,799,473 | A | | 9/1998 | Goblet |
| 5,802,823 | A | | 9/1998 | Woods |
| 5,884,459 | A | | 3/1999 | Biddlecome |
| 5,901,532 | A | | 5/1999 | Bopp |
| 5,953,889 | A | | 9/1999 | Jones |
| 6,044,630 | A | | 4/2000 | Coffin |
| 6,050,067 | A | | 4/2000 | Knight et al. |
| 6,125,616 | A | | 10/2000 | Brown |
| 6,223,509 | B1 | | 5/2001 | Girault |
| 6,272,817 | B1 | | 8/2001 | Further |
| 6,334,262 | B1 | | 1/2002 | Ferrand |
| 6,370,849 | B1 | * | 4/2002 | Merker et al. ..... 54/44.1 |
| 2002/0078666 | A1 | | 6/2002 | Bates |

* cited by examiner

SYSTEM AND METHOD FOR FITTING A HORSE WITH A RIDING SADDLE OR SADDLE PAD

BACKGROUND OF THE INVENTION

1. Field of the Invention

The invention relates to a riding saddle and a pad for a riding saddle having a contoured shape to provide for continuous, conforming, supportive contact between the saddle and the back of a horse. The invention also relates to a system and method for fitting a pad for a saddle on the back of a horse.

2. Description of the Related Art

Bruising and making sore a horse's back has been a problem with known prior art riding saddles, because most saddles concentrate the combined weight of saddle and rider (or pack) at a relatively few and small points of contact between the saddle and the back of the horse. Bruising may result at these points of contact when the pressure exceeds about 1½ pounds per square inch, which is the amount of pressure some considered to be the maximum before bruising occurs.

For example, a typical western-type saddle includes a tree frame with two relatively straight side bars. The natural sway of a horse's back in the vicinity of the center of these bars often prevents supporting contact between the horse's back and the bars at this point. As a result, the combined weight of saddle and rider may be supported or concentrated at the four areas of contact in the vicinity of the forward and rearward portions of each bar. The total effective supportive contact area with this type of saddle (ill-fitting) may be typically about 36 square inches, which results in about 5½ pounds of pressure per square inch of contact for a 200 pound load well in excess of the recommended 1½ pounds per square inch. The amount of pressure exerted by the forward part of the saddle is even more concentrated because saddles are desirably designed to concentrate more of the weight at the forward end of the saddle to be more directly over the horse's front legs. The bruising problem is particularly aggravated when the horse is under saddle for long periods of time over rough terrain. These conditions commonly occur during competitive endurance riding.

Saddles and saddle trees have remained more or less fixed in size and shape based on standards established centuries ago. While some saddle trees are being made from synthetic materials such as plastic and fiberglass, many trees are still being made of wood. A wood tree is covered in rawhide as has been the practice for centuries; or, is covered in fiberglass if more modern materials are being used. As a result, a Western tree may weigh in the neighborhood of forty pounds. By the time leather covering and padding is added, the resultant saddle may weigh upwards of fifty to sixty pounds. The tree itself is typically of one piece construction and comprises a pommel in the front (with or without a horn) and a cantle in the back connected by sidepieces. Basically, there is the Arabian tree and the Quarter horse tree. The only difference being the distance between the sidepieces and the vertical rise of the pommel (so as to fit around the withers without contacting). A saddle tree is supposed to fit over the ridge of a horse's back at both the pommel and cantle and the sidepieces are supposed to fit along the back of the horse on either side of the ridge spreading the weight of the rider over a large area.

Saddles are typically sized by the distance from the pommel to the cantle with a fifteen inch saddle being considered small and an eighteen inch saddle being considered large. Thus, the size variations of standard saddles are relatively small. Unfortunately, such is not the case for the horses.

When placing a saddle on the back of a horse, it is essential that the saddle not tilt to either side or forward/backward. Furthermore, it is important that the saddle not rock longitudinally. Such requirements are attempted to be satisfied by using different kinds of cushion paddings, which are adapted between the horse's back and the saddle frame to places considered functional.

However, the backs of horses have individual shapes both in the transverse and longitudinal direction of the back. Moreover, as the above-mentioned cushion paddings chiefly are factory-made and thus of standard shape and size, such cushion paddings may not satisfy the requirements listed above. Furthermore, ready-made cushion paddings generally comply unsatisfactorily with the shape of the back of the horse, which may cause back pain and even injure the back to the horse. Such an outcome is difficult to prevent, since the poor compatibility of the cushion paddings is typically noted only after the horse's back has become sore. A further problem in the correct placement of the cushion paddings is caused by the saddle which prevents visual and tactile inspection where to add or remove padding. Also the mounting of the rider on the saddle changes its position and complicates the fitting of the paddings.

One attempt to solve the problem of improperly fitted saddles is the banana shaped pad that is curved along its longitudinal length like a banana. Several companies marker a banana shaped pad today. The banana pad may be made of two pieces that are banana shaped so that the pad is contoured to fit the contour of a horse's spine line. The banana pad can be distinguished from standard pads that are just a square felt pad. While banana pads help that do not solve the problem of injury to horse because of ill-fitted saddles. Besides factory-made paddings, also horsehair and rags have been employed for saddle pads. These materials have, however, the same basic deficiencies as factory-made cushion paddings.

Numerous prior art devices have attempted to solve the bruising and the making the backs of horses sore.

U.S. Pat. No. 2,353,622 to Boyle provides for rigid contact plates supported by ball and socket joints at the front and rear of each rail of the saddle. These contact plates do not flex and are unable to continuously conform to the changing shape of the horse's back as it moves. Additionally, the individual plates are not intended to flex in order to conform to the shape of the horse's back.

For example, U.S. Pat. No. 3,286,440 to Walker, et el. provides a lightweight, rigid saddle. This saddle, however, does not specifically conform to the shape of a horse's back and as a result the weight of the rider and saddle may be distributed to only a few points of contact, depending upon the shape of the individual horse's back. Even though the saddle is designed to be lightweight, this does nothing to lessen the weight of the rider or distribute the weight evenly over the surface of the horse's back.

U.S. Pat. No. 3,371,467 to Salisbury provides for a custom, molded fiberglass, reinforced saddle. The saddle tree is reinforced fiberglass made from upper and lower shells. The lower shell is contoured to fit the back of the horse and on each side has a convex front portion adapted to fit onto the withers and a convex rear portion adapted to fit onto the back of a horse, with a central ridge forming a tunnel extending longitudinally of the shell and being sufficiently high to clear the backbone of the horse. The saddle is intended to evenly distribute the weight of the rider and saddle over the back of the horse when the horse is at rest. However, the saddle does not flex to conform to the continuously changing configuration of the horse's back as it is moving. That is, the shoulders of the horse change shape as the horse moves and inasmuch as the weight of the rider and saddle tend to be concentrated at the forward end of the saddle, on the sides of the withers, the bruising and making sore problem continues.

U.S. Pat. No. 3,835,621 to Gorenschek provides for a flexible saddle tree in which the entire saddle is flexible. The invention of the Gorenschek patent requires that the tree frame on the saddle itself be flexible and does not allow for a standard rigid tree frame to be adapted for flexible conforming fit with the back of a horse.

U.S. Pat. No. 4,745,734 discloses a riding saddle including a tree frame having first and second, spaced-apart, generally parallel bars; first and second flexible skirts each having a surface area respectively greater than the surface area of lower face of the side bars; and fasteners coupling the skirts with the lower face of their corresponding bars. The skirts have flexing portions and flex to conform to the contours of the back of the horse on which the saddle is placed and are biased to return to the unflexed position when the saddle is removed from the horse. Preferably, the skirts include a layer of polycarbonate resin or plastic, a layer of foam rubber, and a layer of fleece-like material.

U.S. Pat. No. 5,048,272 discloses attaching a saddle to an equine by means of left and right bar straps attached to the left and right bars in the saddle tree. The bars are slotted to receive the stirrup leathers for mounting in the conventional western style. The use of bar straps does not interfere with such mounting of the stirrups, owing to the way in which the bar straps are mounted to the bars. In a preferred embodiment each bar strap starts on the outside of its associated bar and proceeds upward, over the top of the bar and thence downward along the inside of the bar. If the starting point is very near the bottom of the bar a slot in the bar strap aligns with the stirrup slot in the tree. In another embodiment a long length of strap is looped over the top portion of the bar above the slot, with the outer segment of the loop passing through the stirrup slot. The two portions of the loop rejoin each other on the underside of the bar, where the two proceed downward as one. In either embodiment the bottom end of each bar strap is fitted with an optical transition and with a fastener, such as billet straps, to connect to the remaining portion of the rigging. Owing to the length of the bar straps, the location of the fastening to the remainder of the rigging is such that it is not in the vicinity of the knees of a short rider.

U.S Pat. No. 5,119,618 uses a multi-layer pad that includes a flexible pressure plate members and packets filled with a fluid gel of a silicone material to transfer localized forces from the saddle across the pressure plate which has deformed to the shape of the horse's back thereunder. The packets lie against the pressure plate members with the fluid confined therein between the saddle and the pressure plate members so that localized forces from the saddle are hydraulically transferred over the surface of the pressure plates and over a broad area of the back of the horse.

U.S. Pat. No. 5,195,306 discloses a saddletree constructed of upper and lower plastic shells which are secured together. A first strap passes inside the saddletree below the swell and pommel area and a second strap passes inside the saddletree below the cantle area, both may be attached to the upper surface of the lower shell near the centerline of the saddletree and depend from the saddletree on both sides of the attachment of other saddle rigging components.

U.S. Pat. No. 5,435,116 discloses a racing saddle which flexibly confirms to a horse's back to accommodate the physically characteristics of a given horse, and incorporates a damping system to preclude excessive vibrations in the flexible materials. The saddle tree includes a pair of laterally spaced apart, flexible synthetic skirts connected by a spanning member and a seat element. The seat element is coupled with the respective skirts at two forward pivot mountings, and the spanning member extends between the skirts at a rearward position. The seat element carries a skid assembly at a position just rearward of the pommel, and this assembly deforms under compressive loading to provide damping action. The cantle portion of the seat element slidably and frictionally engages the top of the spanning member.

U.S. Pat. No. 5,802,823 discloses a shock absorbing panel assembly for positioning beneath a saddle and includes right-hand and left-hand panels for positioning in pockets in a saddle pad or blanket on the right-hand and left-hand side of a horse's back. Each panel is of multi-layer construction and includes a base with at least one layer of foam or other cushioning material and one layer of non-cushioning material. The base has at least two recesses and a shock absorbing pad is mounted in each recess to project out of the recess. Each pad also has two layers of cushioning material with an intervening layer of non-cushioning material.

U.S. Pat. No. 6,044,630 discloses a saddle that is constructed around a tree designed using data points based on X, Y, and Z axes which correspond to the conformation of a horse's back. Two pair of torsion springs, attached with specifically placed rivets, sandwich the tree providing structural support. To cushion and maintain the equidistant configuration of the tree, panels are carefully constructed using a six pound foam. The thickness of the panel lessens as it reaches the edge of the tree, preventing bunching when the leather is attached. A withers wedge is secured to the panel adjacent the withers, serving as a sub-support and buffering the contact between the tree and the horse's withers. The cantle wedge is set into the panel to control the slant and angle of the saddle. The stirrup bar is an elongated V-shaped which places the area of greatest pressure directly under the securing rivets.

U.S. Pat. No. 6,334,262 discloses a device and method of measurement of a horse's back that employs a mechanical device having articulated transverse linkages comprising a parallelogram assembly having the first arm as one link, an opposing link, and further comprising a hub member, with transverse opposing wings each of the wings being pivotally joined to the hub member for defining shape and indicia to determine a series of angles. The measuring device is able to describe angles and arcs in order to determine the convex and concave portions of polyform shapes—in this preferred embodiment relating to animal backs and their corresponding saddles. The disclosed invention describes a method and formula to adjust the shape of such a device to compensate for the weight of the rider relative to the weight of the animal as well as additional factors is also provided by this process. Additional calibration of the measuring device can also be refined by employing interface pressure measurement.

It is an object of the present invention to achieve a system and method capable of overcoming the above-described problems and making it possible to correctly fit the back for each horse individually in a manner avoiding incorrect loading of the horse's back.

It is another object of the invention to provide a system and method for fitting and selecting a correctly contoured pad closely conforming to the shape of the back of the horse being fitted.

It is another object of the invention to provide a system and method for selecting a correctly contoured shell for making a saddle that is fitted to a horse's back.

It is another object of the invention to make it possible to use a conventional saddle on a horse using a fitted cushioned pad closely conforming to the shape of the back of the horse to avoid incorrect loading of the horse's back.

In is another object of the invention to provide a fitted cushioned pad closely conforming to the shape of the back of the horse that can be used at any time with different saddles on a horse.

It is another object of the invention to provide a system and method for making a custom fitted saddle conforming to the shape of a horse's back for making a saddle that is fitted to a horse's back.

Other objects of the invention will be apparent from the following disclosure, specification and claims.

BRIEF SUMMARY OF THE INVENTION

The invention include a method for custom fitting a horse's back with a fitted saddle pad or saddle The method includes fitting a, molded shell to a horses back to determine the proper size and shape shell for the horse to distribute the weight of a rider over a large area of the horse's back to minimize pressure points. A fitter then selects a molded shell for the horse to determine the size and shape of the horse's back for a properly fitted saddle pad or saddle so that substantially the entire lower surface of the saddle pad or saddle contacts the horse's back to minimize pressure points.

The invention also includes a system for custom fitting a horse's back with a fitted saddle pad or saddle. The system includes a plurality of molded shells for fitting to a horse's back to determine the proper size and shape shell for the horse to distribute the weight of a rider over a large area of the horse's back to minimize pressure points. The shells have means to allow a fitter to determine the correct size shell for selecting a molded shell for the horse to determine the size and shape of the horse's back for a properly fitted saddle pad or saddle so that substantially the entire lower surface of the saddle pad or saddle contacts the horse's back to minimize pressure points. The means to allow a fitter to determine the correct size may be a plurality of holes in the shell.

DETAILED DESCRIPTION OF THE INVENTION

Figure 1:
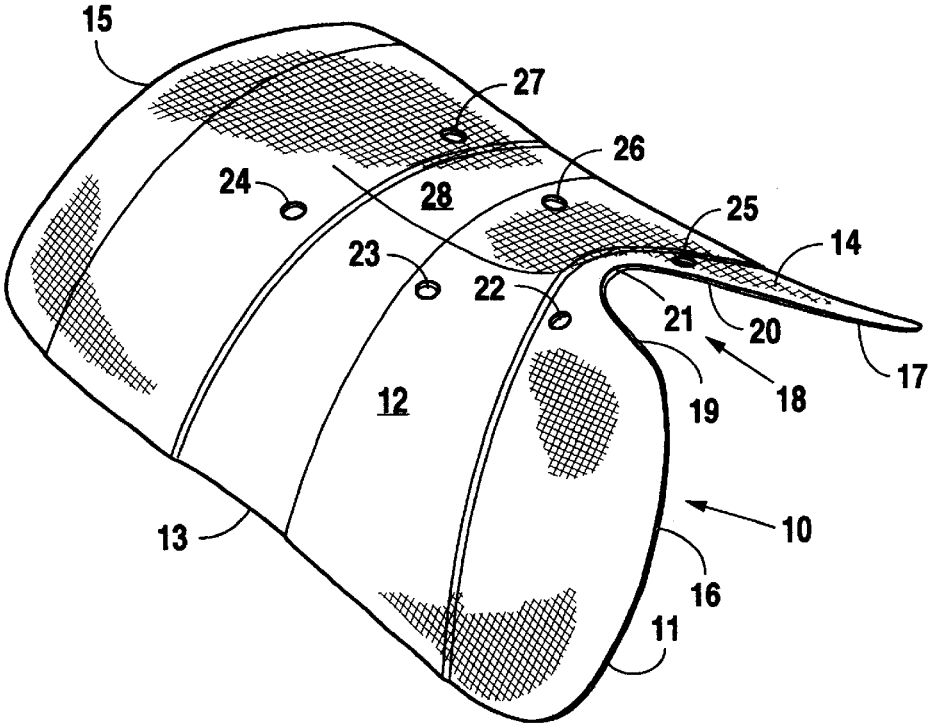
FIG. 1 is a perspective view of a fitting shell of the invention.
Figure 3:
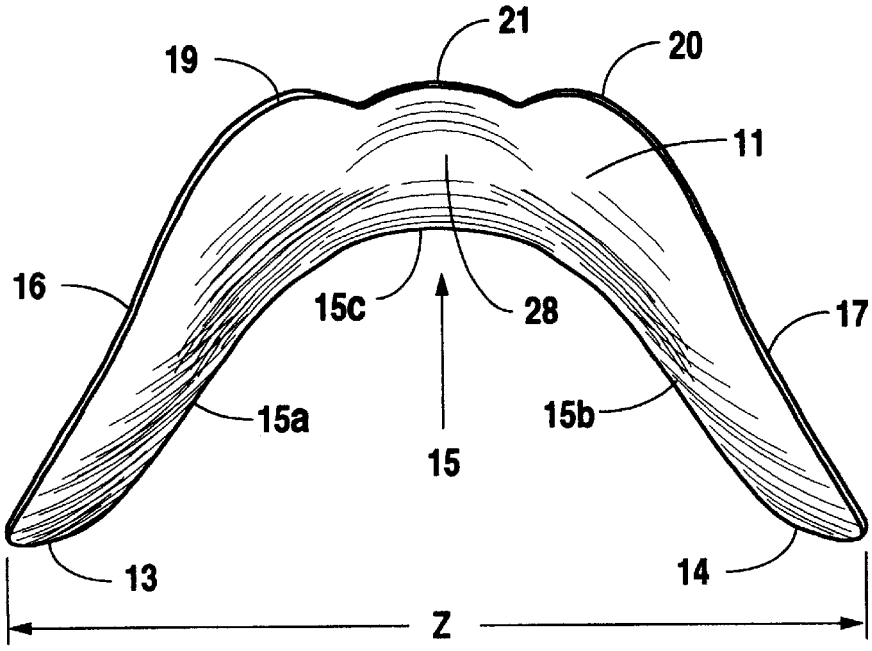
FIG. 3 is an end view of a fitting shell of the invention.

Referring to FIG. 1, there is shown one of the fitting shells of the invention. Each fitting shell includes a shell 10 having a lower surface 11 and an upper surface 12. The shell 10 is defined by the side edges 13 and 14 and the back edge 15. There are two equal front edges 16 and 17 and front notched out portion 18 have side edges 19 and 20 and a inner edge 21. As shown in FIG. 3, the back edge 15 has side portions 15*a* and 15*b* and upper portion 15*c*.

A plurality of measuring openings 22, 23, 24, 25, 26, and 27 are provided in the shell 10. The openings are positioned at strategic positions of the shell to identify major contact points of the shell 10 with a horse's back.

The shells may be made of glass reinforced fiberglass which may be opaque. The holes 22, 23, 24, 25, 26, and 27 allow the fitter to observe the contact of the lower surface 11 of the shell with a horse's back. The shells could also be fabricated from transparent material that would allow a fitter to observe the entire contact between the shell and a horse's back.

Figure 2:
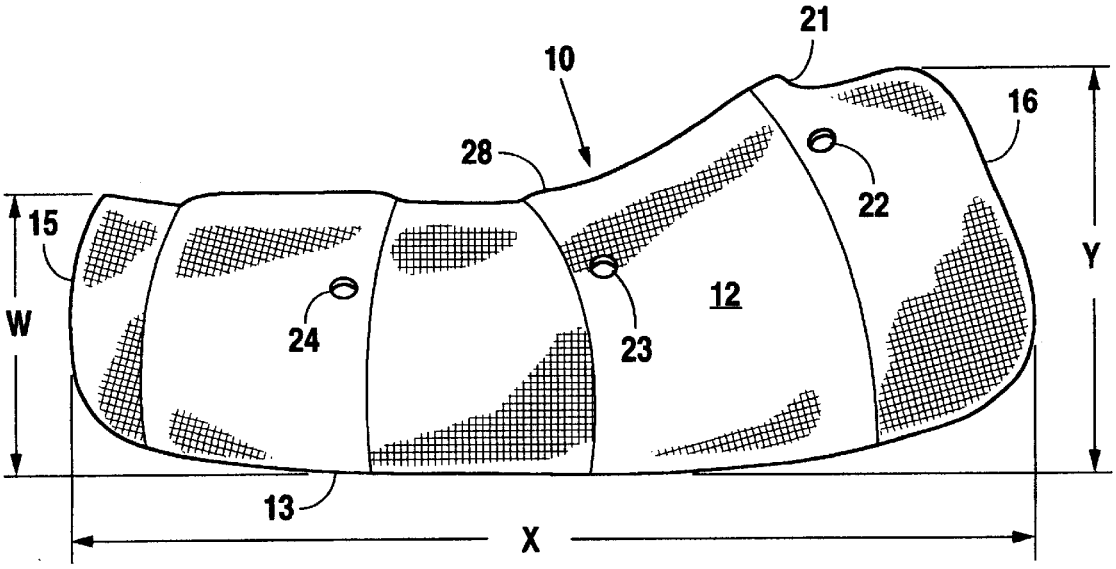
FIG. 2 is a side view of a fitting shell of the invention.

A series of up to nine shells may make up a fitting system. The shells are of various sizes starting from the smallest to the largest. The dimensions of the shells vary by varying the distance between side edges 13 and 14 which determines the overall width of the shell. The shells also vary in the distance between back edge 15 and front edges 16 and 17. The shells also vary in the amount of upper curvature of the shell as shown in FIG. 2. The shells may have a lengthwise size indicated by X, a rear height indicated by W, a front height indicated by Y and a front width indicated by Z.

The sizing of the shells was determined by measuring the backs of numerous horses for custom fitted saddles. It was discovered that almost all horses usually fall into about nine to eleven categories of varying sizes. By having nine–eleven different sizes, most horses can be fitted with a shell that will provide sufficient amount of contact with the horse's back to avoid excess pressure points. The sizes of the shells used may also vary by the breed.

The ideal is to put pressure on the center of the back of the ribcage of a horse and to incline up over the loin area. This gives maximum contact of the saddle with the horse by making contact all the way over the ribcage. The total surface area of each shell is approximately 600 square inches. The goal is to contact the horse's back with about 400 square inches of the shell. Another goal is to the avoid contact with the spine with a crown 28 over it. The shells are sloped up so they do not touch the horses scapula or wither or loin and are also sloped up on the back end 15. The sizes for eleven shells in a fitting set in inches may be in the order of the following at the base of the shell starting from the front to the rear at eight inch intervals. The rock is measured from the center of the shell down 3.5 inch and 8 inch intervals.

| Applicant's Sizes | Front | 8 inches | 16 inches | 24 inches | |
|---|---|---|---|---|---|
| 8½ | 14.000 | 14.750 | 16.000 | 17.250 | Base |
| | 8.375 | 4.75 | 4.125 | 4.8757 | Rock |
| 8 | 15.750 | 16.375 | 17.250 | 18.000 | Base |
| | 7.75 | 4.25 | 3.75 | 5 | Rock |
| 6 | 16.500 | 16.500 | 17.000 | 18.000 | Base |
| | 7.375 | 5.5 | 4.75 | 5.75 | Rock |
| 9 | 16.500 | 16.250 | 17.000 | 18.000 | Base |
| | 8.25 | 5.25 | 4.75 | 5.75 | Rock |
| 6.5 | 16.750 | 16.625 | 17.625 | 18.000 | Base |
| | 7.75 | 5 | 4.375 | 5.125 | Rock |
| 6 | 17.500 | 17.500 | 18.250 | 18.500 | Base |
| | 8 | 4.625 | 4.125 | 5.125 | Rock |
| 2 | 18.250 | 17.500 | 17.750 | 18.250 | Base |
| | 7.75 | 5.25 | 4.875 | 5.625 | Rock |

-continued

| Applicant's Sizes | Front | 8 inches | 16 inches | 24 inches | |
|---|---|---|---|---|---|
| 12 | 17.000 | 16.500 | 17.125 | 17.500 | Base |
| | 7.875 | 4.25 | 3.5 | 5.125 | Rock |
| 11 | 17.250 | 17.125 | 17.875 | 18.000 | Base |
| | 7.75 | 4.75 | 3.625 | 4.75 | Rock |
| 13 | 21.000 | 19.000 | 19.500 | 19.500 | Base |
| | 9.375 | 5.25 | 4.75 | 5.875 | Rock |
| 3 | 21.000 | 21.000 | 20.250 | 20.250 | Base |
| | 8.125 | 4.875 | 3.875 | 4.625 | Rock |

A plurality of holes 22, 23, 24, 25, 26, and 27 are formed in the fitting shells to enable a person fitting a horse to determine the locations of the back of the horse that are being contacted. There are three to four holes formed in the fitting shells in the pocket area. Generally, this is a hole over the scapula to indicate proper contact with the back of the horse. The shell should fit down in the right wither pocket and come up over the capicious muscle that runs right down into it and then over the scapula. This causes the pressure to be on top of the horse's back. This enables a better fit so the saddle does not adversely affect a house's back. A fitted saddle or pad does not affect a horse as much by avoiding hurting a horse's back so a saddle and rider doesn't hurt the horse's back.

Generally a fitted saddle is better than a fitted pad with a regular saddle depending on the application. A saddle is usually better because both the leverage is reduced as it is rolled over the back, the less pressure you are going to exert on the front end.

If a rider ropes a steer a 600 pound steer, the higher the saddle horn is off of the horse's back, the more leverage you apply on the shoulders of the horse. One disadvantage of having a conventional saddle tree on top of a fitted pad is the thickness of the bars which adds to the height of the saddle horn relative to the horse's back. A fitted pad with a conventional saddle my increase the leverage by about 2 inches. This is significant if you consider the 2 inches added height on a 32 foot rope lassoed on a 200 pound animal For an average rider the fitted shell pad is probably adequate because it helps distribute the weight of the rider on the saddle on a larger surface area of the horse's back. But for a cowboy that is roping or pulling or doing a lot of hard riding it is preferable to have a fitted saddle.

For barrel racers, shaving two to four tenths of a second off of the barrel racer's time using a fitted pad, even with the additional weight of a conventional saddle on top of it, is more that worth the extra cost. This is possible because the horse feels better, the horse is not hurting and the horse will perform more. The horse is also likely to put more effort into its work because it is not hurting.

The use of the fitted saddle pad or fitted saddle will decrease the times for the barrel racers. The biggest improvement can be realized for roping horses because the horses are really anticipating back pressure and pain. Roping horses often start moving to the side to get away from the pressure that hurts them. They can stand still then because it doesn't hurt them. When roping horses are not experiencing pain they my slide up to 20 feet after the calf is roped and will work backward and stop and hold the calf.

The use of the fitting shells is as follows. A person or company desiring to fit a horse needs a set of the fitting shells in the various sizes. The fitter needs training to know what are the important contact points of the horse's back and how to recognize which size shell properly fits best. The various sized shells are then tried to determine the best fit. Once the fitter has determined the best size fit for the horse, a shell is selected which might be number seven shell out of the nine shell. If the customer wanted a saddle pad then the correct size saddle pad could be selected from stock or ordered. If the customer wants a completed saddle, the correct size saddle would typically be ordered and manufactured using leathers and designs selected by the customer. A customer might typically bring a horse into the store for a fitting. Or a fitter could go to the horse for fitting. Once the optimal size has been determined a properly fitted saddle pad or entire saddle could be obtained and would closely approximate a saddle made from an impression of the horse's back.

In the case of a saddle, a shell corresponding to the selected fitting shell would be chosen for making a saddle. A wooden tree could be fitted to the selected shell and the saddle maker could put the selected leather and rigging on the tree and shell to make the saddle.

When a horse is fitted with the correct size shell, a fitted pad could likely be quickly obtained because of its relatively low cost to retrofit that person's horse that day with a fitted pad. A complete saddle could then be ordered and delivered when finished.

Figure 4:
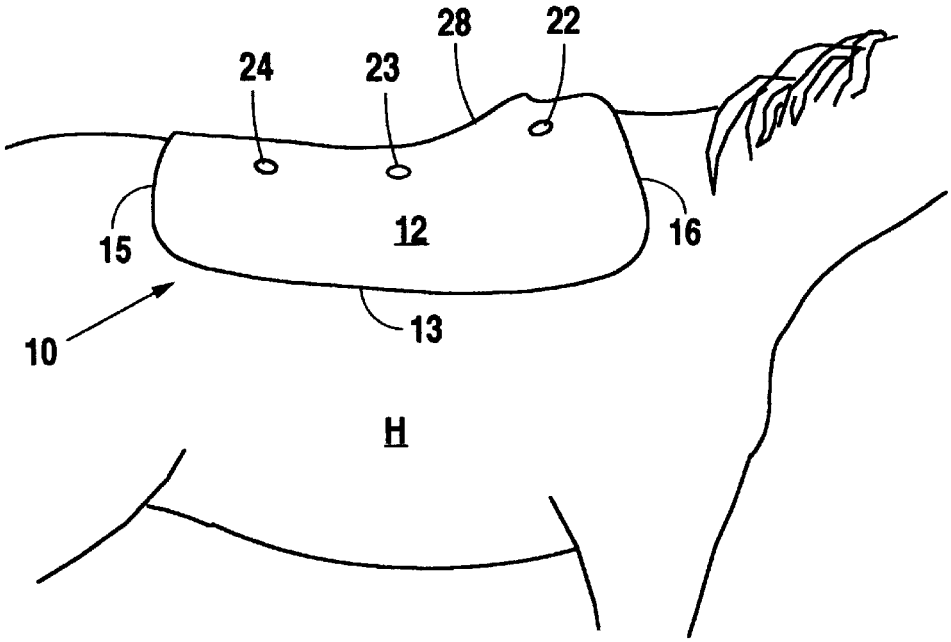
FIG. 4 shows the place of a fitting shell of the invention on a horse.

As will be apparent, a person using the fitting shell needs to understand the proper fit. The fitter needs to understand the right way to select the proper shell to fit each horse. A fitter with experience will typically start with what they think is the best fit. They would then just physically put selected ones of the shells on the horse's back as shown in FIG. 4 and observe the holes 22, 23, 24, 25, 26, and 27 in the shell and around the edges to see which is the closest fit. The fitter should make sure that the shell flares up on both ends with the contact primarily in the center part of the shell and no contact on the ends. The fitter would observe the shell on the horse H as shown in FIG. 4 and make sure the shell is the right width. A flexible pad would typically be provided with the fitting shells. The thick pad is separate from the fitting shells. The fitter first tries the shells on without any pad.

The fitter would then put the pad on the horses back and then go back and refit the shells to make sure they got adequate contact on the whole center section all the way down on the sides. Once the fitter has done these steps then it is determine which size of shell should be used for a horse.

The actual shell used for a completed pad or saddle would have a thick absorbent pad adhered or attached to the bottom surface 11 of a pad. This would also apply to a fitted saddle. In the case of a pad, the upper surface 12 would be a rough or other friction cause surface so that a saddle would stay in place of a pad without undesired slipping.

Different saddles use different bars and different types of riggings. With conventional saddle trim and a conventional tree, to get a good fit, the rigging has to be placed on that tree in the right position to hold that tree in the right spot on a horse's back. If the saddle maker puts the rigging to far forward on the board it makes the tree slide back.

With the final shells used for a saddle the rigging position is predetermined because the rigging is attached to the shell with locators on the shell to put the rigging in the right place. There is a raised section on the shell that the fiberglass forms around for sliding the rigging under. The slots will always be the same for almost every horse that a shell fits on. The saddle is Yeah, the fitting system with a conventional tree is not going to improve, I mean its going to improve fit now there is a way to size a horse tell them what he really is and get something that's close to a fit, but its not going be, its not going to have the impact that this thing has.

Now this saddle is easier to build because all of the fiberglass shells for each size are the same. The fiberglass may already include the rigging straps to facilitate attachment of the saddle parts. The completion of the saddle, once the correctly sized shell is selected is standard.

The invention makes it possible to adapt any saddle on any horse in an individually optimal fashion avoiding incorrect loading of the horse's back. Furthermore, the fitted cushioned pad made according to the method can later be used at any time with different saddles on said horse.

I claim:

1. A method for custom fitting a horse's back with a form fitted saddle pad or saddle, comprising the steps of:

alternately placing a plurality of different sized and shaped molded shells onto the horse's back to determine the closest size and shape shell for the horse that when fitted in a saddle or pad would distribute the weight of a rider on the horse over a large area of the horse's back to minimize pressure points;

said shells having a plurality of spaced viewing holes or openings in the shells to allow a fitter to see the contact of the shells with the horse's back to determine the closest size and shape shell for selecting a molded shell for the horse's back for a properly fitted saddle pad or saddle so that substantially the entire lower surface of the correctly sized and shaped shell contacts the horse's back to minimize pressure points;

selecting the closest molded shell for the horse's back corresponding to one of the plurality of different sized and shaped molded shells based on the fitted size and shape of the horse's back for the form fitted saddle pad or saddle so that substantially the entire lower surface of a saddle pad or saddle made from the selected shell contacts the horse's back to minimize pressure points; and manufacturing a saddle or pad from the closest sized shell corresponding to the selected closest sized shell for a properly fitted saddle pad or saddle so that substantially the entire lower surface of the saddle pad or saddle contacts the horse's back to minimize pressure points.

* * * * *